United States Patent [19]

Sanders

[11] 4,032,148

[45] June 28, 1977

[54] GAME APPARATUS

[76] Inventor: Richard E. Sanders, B. P. 10, Doba, Chad. Africa

[22] Filed: Sept. 18, 1975

[21] Appl. No.: 614,563

[52] U.S. Cl. ..... 273/120 R; 46/43; 273/121 E

[51] Int. Cl.[2] ..... A63D 3/02

[58] Field of Search ..... 273/39, 86 C, 120 R, 273/120 A, 121 D, 121 E; 46/42, 43

[56] References Cited

UNITED STATES PATENTS

| | | | |
|---|---|---|---|
| 1,350,384 | 8/1920 | Parker | 273/120 R |
| 1,826,215 | 10/1931 | Hutchison | 273/120 R X |
| 3,012,364 | 12/1961 | Johnson | 46/43 |

FOREIGN PATENTS OR APPLICATIONS

| | | | |
|---|---|---|---|
| 19,633 | 12/1890 | United Kingdom | 273/39 |

*Primary Examiner*—Anton O. Oechsle
*Attorney, Agent, or Firm*—Wheeler, Morsell, House & Fuller

[57] ABSTRACT

A game for use by the physically handicapped in which depressing an end of a large lever causes an elevator mechanism to raise a ball to an entry track which automatically conveys the ball to a gameboard by means of gravity. After leaving the gameboard, the ball enters a return track and automatically returns to the elevator due to gravity. The elevator includes a ball lifting surface which is inclined away from the return track and toward the entry track.

6 Claims, 3 Drawing Figures

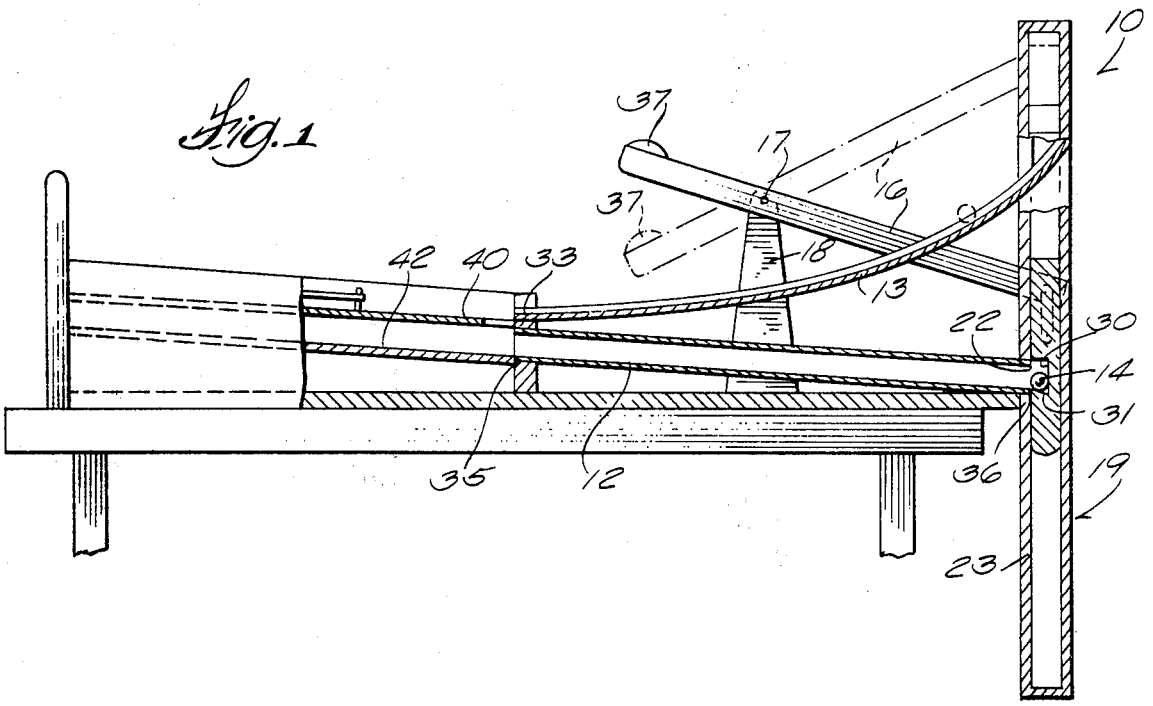
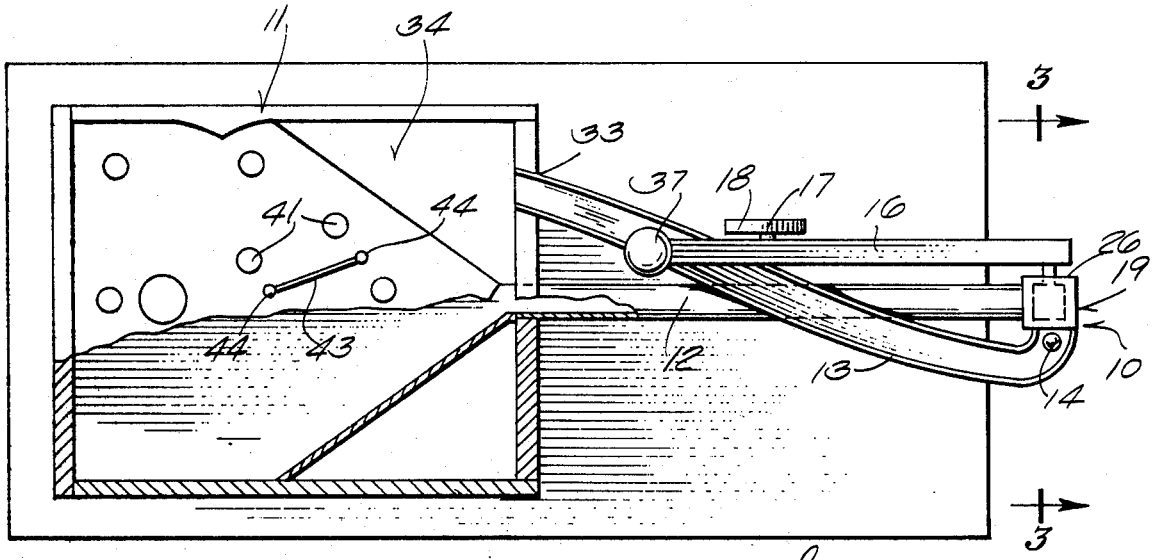
Fig. 2
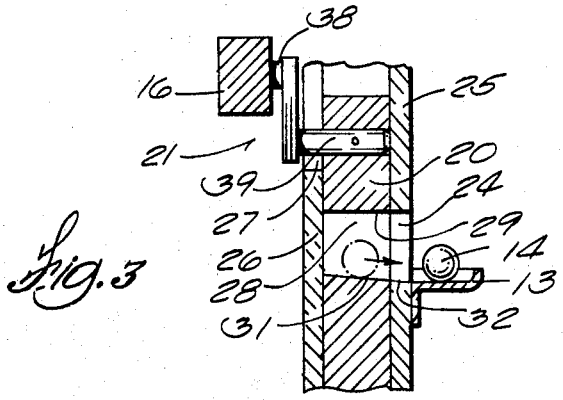
Fig. 3

GAME APPARATUS

BACKGROUND OF THE INVENTION

Although the prior art discloses means for raising playing pieces from a lower level to a higher level using a lever-actuated reciprocating elevator mechanism, no previous device discloses the distinctive features and advantages of the present invention.

Converse U.S. Pat. No. 348,952 discloses a toy which is so arranged that as balls are added to the bottom of a stack of balls, the stack is forced upward, and when the stack has reached the height of the outlet, the ball at the top of the stack emerges through an outlet hole. As a result, the device cannot operate unless several balls are employed, whereas the present invention will operate if one or more balls are employed. Second, the Converse device is so arranged that a ball can only be vertically displaced by its own diameter when the lever is raised and lowered once, which means that the lever must be raised and lowered several times before balls begin to emerge from the outlet hole for the first time. By contrast, in the present invention, a playing piece will emerge the first time the lever is raised and lowered. Third, the Converse patent requires that a spring catch be employed to support the column of balls, while the present invention requires no such catch in order to function properly.

Johnson U.S. Pat. No. 3,012,364 also differs importantly from the present invention. In order to transfer a ball from the inlet hole to the outlet hole, Johnson uses lower and upper movable receptacles, having oppositely slanted lifting surfaces, and a fixed intermediate receptacle having a hinged lower face which changes its inclination in response to movement of the slideably-mounted rod. The process requires that the lever be raised and lowered twice before the first ball emerges. Unlike the Johnson invention, the present invention uses a single moveable lifting surface which is fixed with respect to the slideable rod to raise the playing piece. Also, a playing piece emerges from the outlet hole the first time the lever is raised and lowered. The present invention also discloses an innovation whereby entrance and exit paths, when viewed along the axis of the standard, are transverse to each other. This allows a single lifting surface with constant inclination to perform the same function as Johnson's two lifting surfaces and his intermediate receptacle having a lower surface with changing inclination.

SUMMARY OF THE INVENTION

The present invention relates to game apparatus in which manual movement of a large lever causes an elevator to raise playing pieces to an entry track so that the pieces travel onto, across, and off of a game board and return to the inlet hole of the elevator, all by means of gravity.

The elevator used in this invention employs a lifting surface of constant orientation incorporated into a rod slideably mounted in a hollow standard. Because the lifting surface is inclined with respect to both the inlet path and the outlet path, and because the inlet and outlet paths are transverse to each other when viewed along the axis of the rod, playing pieces move into the inlet hole and out of the outlet hole due to the acceleration of gravity, whereby only one receptacle and no surface with changing inclination is required.

It is an object of this invention to provide a game for the physically handicapped or unskilled in which the only manual operation required of participants is the gross manipulation of a simple actuation mechanism that raises playing pieces to the top of an inclined track, so that the playing piece may gain sufficient momentum through the action of gravity to allow the game to proceed automatically, and to make the operation as simple as possible.

In addition to providing diversion, the game apparatus of this invention can be adapted to facilitate educational and teaching games, depending upon the arrangement of the game board, the rules of the game, and so forth.

Other objects and advantages of the invention will be apparent from the description which follows.

DESCRIPTION OF THE DRAWINGS

FIG. 1 is a side view of the elevator and an associated game, showing the rod in positions for inlet and outlet of the playing piece.

FIG. 2 is a top view of the apparatus shown in FIG. 1.

FIG. 3 is a cross-sectional view on line 3—3 of FIG. 2.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment is described below, the details may be changed without departing from the invention, which is defined by the claims.

The preferred embodiment of the invention consists of an elevator 10, a gameboard 11, return and entry tracks 12 and 13, and at least one playing piece such as balls 14. Elevator 10 consists of lever 16, fulcrum pin 17, fulcrum support 18, hollow standard 19, rod 20 and a lever linkage assembly 21 which links lever 16 to rod 20.

Hollow standard 16 has an inlet hole 22 drilled in the face or wall 23 closest to gameboard 11 and has an outlet hole 24 drilled in an adjacent face or wall 25, each hole being large enough to permit a playing piece 14 to move between the interior and exterior of the standard. The far face or wall 26 of the standard is slotted at 27 to accomodate the lever linkage 21 described below.

Inside standard 19 is a slideably mounted rod 20 which is confined to movement along the long axis of the space inside standard 19. In this embodiment, a receptacle 28 is formed in the body of the rod 20, having an upper face 29, a back face 30 and an inclined planar lifting surface 31, which is sloped away from the forward face 23 of standard 19 and toward the adjacent face 25 thereof. The portion of the rod 20 below the lifting surface 31 is of such a length that when the rod 20 is raised so the lifting surface 31 lies beside or slightly above the lower edge 32 of outlet hole 24, the lower part of the rod 20 continues to block the inlet hole 22.

As can be seen by an inspection of the figures, especially FIGS. 1 and 3, lifting surface 31 of the lifting rod is obliquely inclined both away from inlet hole 22 and toward outlet hole 24. Thus it can be seen that lower surface 31 cooperates with side walls 25 and 26 of standard 19 to form an inwardly inclined entry channel for playing piece 14 when receptacle 28 of the lifting rod is located adjacent the entry hole. Similarly, front wall 23 of the standard and back face 30 of the receptacle cooperate with the lifting surface to form an outwardly inclined exit channel when the receptacle is aligned with exit hole 24.

Entry track 13 inclines away from the outlet hole 24 and toward the gameboard 11. The upper gameboard 11. The upper end of entry track 13 is attached at or below the lower edge 32 of the outlet hole 24, and its lower end is attached at 33 on or above the gameboard face 34. The upper end of the return track 12 is attached at or below the lowest point 35 of the gameboard 34. The lower end of the return track 12 is attached at or slightly above the lower edge 36 of the inlet hole 22 at the forward face 23 of the standard 19.

The lever 16, being rotatably attached to fulcrum support 18 by fulcrum pin 17 and having handle 37 attached at one end, is rotatably linked to linkage 21 by pin 38. Pin 39 rotatably connects linkage 21 to the upper end of rod 20 through slot 27 on the far side face 26.

The device operates as follows. When the handle 37 of lever 16 is raised until the lever is in the lower position illustrated by solid lines in FIG. 1, so that the forward edge of lifting surface 31 is at or slightly below the level of lower edge 36 of the inlet hole 22, a playing piece 14 waiting in return track 12 will move backward by gravity onto the lifting surface 31 until piece 14 comes to rest against back face 30 of rod 20 at which point the piece 14 lies entirely within the receptacle 28 in standard 19. When lever 16 is then moved to its upper position illustrated by dashed lines in FIG. 1 by downward pressure on handle 37, the lever linkage assembly 21 will lift rod 20 vertically until lifting surface 31 is at or slightly above lower edge 32 of the outlet hole 24. At this point lifting surface 31 is inclined toward the outlet hole 24, and playing piece 14 will move by gravity onto entry track 13. Meanwhile the lower edge of rod 20 will block inlet hole 22 in such a way that further playing pieces 14 will not be able to enter the inside of standard 19 until rod 20 has returned to the lower position illustrated by solid lines in FIG. 1.

Playing piece 14 now moves along entry track 13, accelerating due to the force of gravity, until it reaches gameboard 11. After having completed its time on the board, either because of entrapment or loss of potential energy, playing piece 14 eventually arrives at 35, the lowest part of the board 34 accessible to playing piece 14. From point 35, playing piece 14 travels by gravity down return track 12 until it reaches either inlet hole 22 or a line of other playing pieces 14 on return track 12 immediately outside inlet hole 22, whereupon it comes to rest until set back into play by operation of the elevator mechanism 10.

The gameboard 34 disclosed in the drawings to illustrate the invention includes an inclined upper surface 40 onto which the entry track 13 deposits playing pieces 19, said upper surface 40 being inclined so that all points of the surface incline toward one or more holes 41 therein, and a lower surface 42 inclined toward its lowest point 35. Holes 41 are sized so that playing pieces 14 will fall through to the lower surface 42 upon encountering said holes. Gameboard 34 also includes one or more elastic bands 43, each stretched between supports 44 in such a way that playing pieces 14 will rebound when contacting elastic band 43 at an appreciable speed. A playing piece 14 which moves onto the upper surface 40 will continue to move about, possibly rebounding upon contact with elastic bands 43, until said playing piece 14 encounters and falls through a hole 41 in upper surface 40 to lower surface 42 until it reaches lowest point 35. From there, playing piece 14 moves onto return track 12 by means of gravity.

I claim:

1. In an improved elevator associated with a gameboard, a hollow upright standard having walls sized to contain spherical playing pieces and having upper and lower ends, a rod slideably mounted within said standard, and inlet hole on the lower part of the standard, an outlet hole on the upper part of the standard, said holes communicating between the interior and exterior of the standard, and arranged so that the playing piece leaves the standard through the outlet hole transverse to the direction in which the playing piece enters the standard through the inlet hole, a fixed planar lifting surface formed in the rod, said lifting surface being inclined obliquely to slope both toward the outlet hole and away from the inlet hole, the inclination of the surface being in a direction between the orientation of the inlet hole and the orientation of the outlet hole, said surface cooperating with two of said walls to form a channel to admit a piece from the inlet hole in a first direction and cooperating with another said wall to form a channel to discharge a piece from the outlet hole in a second direction, and means for sliding said rod in said standard from a lower position in which the lifting surface is aligned with the lower edge of the inlet hole to an upper position in which the lifting surface is aligned with the lower edge of the outlet hole.

2. The game of claim 2 in which said means for sliding said rod comprises a large lever which can be moved by a body movement.

3. The elevator of claim 1 in which said standard is rectangular in cross-sectional shape, and said inlet and outlet paths form an angle of 90 %.

4. The elevator of claim 2 in which said lifting surface is the upwardly-facing lower surface of a receptacle formed by an indentation in said slideably mounted rod.

5. The elevator of claim 1 in which said means for sliding said slideably mounted rod consist of a lever linked to the slideably mounted rod and to a fixed fulcrum.

6. The game of claim 1 and further comprising a first upwardly facing inclined track connected between the inlet hole and the gameboard and inclined toward said inlet hole and a second upwardly facing inclined track connected between the outlet hole and the gameboard and inclined toward said gameboard.

* * * * *